US006443854B1

(12) United States Patent
Calboreanu

(10) Patent No.: US 6,443,854 B1
(45) Date of Patent: Sep. 3, 2002

(54) ANODIZED ALUMINUM GOLF CLUB HEAD AND METHOD OF MANUFACTURING SAME

(75) Inventor: George A. Calboreanu, Longmont, CO (US)

(73) Assignee: A. R. Wilfley & Sons, Inc., Denver, CO (US)

( * ) Notice: Subject to any disclaimer, the term of this patent is extended or adjusted under 35 U.S.C. 154(b) by 0 days.

(21) Appl. No.: 09/277,719

(22) Filed: Mar. 26, 1999

Related U.S. Application Data

(60) Provisional application No. 60/079,390, filed on Mar. 26, 1998.

(51) Int. Cl.[7] ..... A63B 53/04; A63B 53/06; B32B 15/10

(52) U.S. Cl. ..... 473/324; 473/349; 473/409; 428/650

(58) Field of Search ..... 473/345, 349, 473/324, 346, 347, 348, 409; 427/376, 650, 253.394; 428/651, 629

(56) References Cited

U.S. PATENT DOCUMENTS

| | | | | | |
|---|---|---|---|---|---|
| 2,908,502 | A | | 10/1959 | Bradstreet et al. | |
| 4,517,616 | A | * | 5/1985 | Bischoff | 428/164 |
| 4,768,787 | A | | 9/1988 | Shira | |
| 5,037,102 | A | * | 8/1991 | Fukayama et al. | 273/167 J |
| 5,207,427 | A | * | 5/1993 | Saeki | 273/167 R |
| 5,322,285 | A | * | 6/1994 | Turner | 273/164.1 |
| 5,342,812 | A | * | 8/1994 | Niskanen et al. | 501/127 |
| 5,458,334 | A | | 10/1995 | Sheldon et al. | |
| 5,472,202 | A | | 12/1995 | Yamanaka | |
| 5,486,223 | A | | 1/1996 | Carden | |
| 5,487,543 | A | | 1/1996 | Funk | |
| 5,531,444 | A | | 7/1996 | Buettner | |
| 5,669,827 | A | * | 9/1997 | Nagamoto | 473/345 |
| 5,788,584 | A | * | 8/1998 | Parente et al. | 473/290 |
| 5,945,157 | A | * | 8/1999 | Lee et al. | 428/128 |

* cited by examiner

*Primary Examiner*—Paul T. Sewell
*Assistant Examiner*—Sneh Varma
(74) *Attorney, Agent, or Firm*—John E. Reilly

(57) ABSTRACT

An aluminum alloy product of extremely high hardness is conformable for use in the manufacture of various products, such as, golf clubs and pump partshaving a body or first layer of an aluminum alloy treated by successive precipitation hardening and reverse quenching to produce a hardness exceeding 140 HBN, and an outer alumina layer or surface coating is applied by hard-anodizing to a predetermined thickness on the first layer and being of even greater hardness than the first layer.

9 Claims, 1 Drawing Sheet

ANODIZED ALUMINUM GOLF CLUB HEAD AND METHOD OF MANUFACTURING SAME

CROSS-REFERENCE TO RELATED APPLICATION

This application claims the benefit of Provisional Application Serial No. 60/079,390, filed Mar. 26, 1998 for ANODIZED ALUMINUM GOLF HEAD AND METHOD OF MANUFACTURING SAME, by George A. Calboreanu and assigned to the assignee of the present application.

BACKGROUND AND FIELD OF INVENTION

This invention relates to anodized aluminum surface layers for metal products, and more particularly relates to novel and improved metal products with outer anodized layers as well as a method of manufacturing same which are characterized by possessing high yield strength and hardness. For the purpose of illustration but not limitation, the present invention will be described in connection with athletic implements and, in particular, golf club heads. It will be apparent that the invention is readily conformable for use in the manufacture of other products which have requirements for related properties or characteristics. Numerous attempts have been made to optimize the performance of golf clubs and particularly golf club heads to increase or improve their ball-striking capability both with respect to distance and accuracy. With the advent of metal golf club heads there has been a constant search for a metal alloy structure that would optimize performance without unduly increasing the cost of fabrication while at the same time complying with USGA rules governing golf club design and construction.

In the construction of metal clubs, especially the so-called metal woods, the basic materials used are forged carbon steels, investment or sand cast stainless steels, copper based, nickel based, or titanium based alloys. U.S. Pat. No. 5,037,102 to Fukayama describes a golf club head having a contact surface harder than the head and made up of a combination of aluminum or aluminum alloy combined with powdered ceramics. U.S. Pat. No. 4,768,787 to Shira utilizes alumina, or hardened aluminum, in forming a frictional contact surface, the hardened materials or particles protruding above the surface to provide greater frictional contact with the golf ball.

In U.S. Pat. No. 5,342,812 to Niskanen, et al a composite head utilizes in part an alumina material. U.S. Pat. No. 5,458,334 to Sheldon, et al discloses a process for making golf club heads by electro-spark deposition. U.S. Pat. No. 2,908,502 to Bradstreet, et al discloses a golf club head having an impact surface coated with a roughened, granular crystalline oxide coating which is selected from the group consisting of routile and alumina. Other representative patents are those U.S. Pat. No. 5,207,427 to Saeki; U.S. Pat. No. 5,472,202 to Yamanaka; U.S. Pat. No. 5,486,223 to Carden; U.S. Pat. No. 5,487,543 to Funk; and U.S. Pat. No. 5,531,444 to Buettner.

Notwithstanding the ever-increasing activity in this field and attempts to improve club head design and construction, no one to the best of my knowledge has successfully devised a lightweight aluminum golf club head with a hard anodized alumina surface. "Hard anodizing" is the process which produces a substantially heavier coating or surface layer than conventional anodizing for a given length of time. Alumina crystallizes in a hexagonal system, is very stiff and has a density of 3.99 g/cm$^3$ which will not materially affect the total weight of the club head. The aluminum density being on the order of 2.7 g/cm$^3$, the overall size of the club head can be larger than existing metal club heads, and the total weight of the head can still be within the maximum 205 g allowed by USGA rules. It has been found that the enlarged head size and striking surface greatly minimizes distortion or twisting when contacting the golf ball thereby reducing any tendency to slice or hook the ball. Other advantages include minimal costs of fabrication, ability to undergo violent shock without cracking, improved life and ball-striking characteristics owing to the strong adherence of the anodized layer(s) to the aluminum body of the head as well as uniformity of thickness of the layer(s).

The characteristics of the hard-anodized layer can be greatly enhanced by utilizing in combination with an inner core or layer of high hardness in excess of 90 Brinell or "HBN". Optimally, the inner layer is a metal or metal alloy which is precipitation hardened followed by reverse quenching to result in a hardness on the order of 190–210 HBN or higher. The reverse quenching, in which the article is successively exposed to a low temperature liquid followed by a higher temperature liquid, has been found to dramatically reduce cracking in the outside anodized layer of the resultant product.

SUMMARY OF THE INVENTION

It is therefore an object of the present invention to provide for novel and improved method of manufacturing athletic implements, particularly those of the type having a ball-striking surface.

It is another object of the present invention to provide for a novel and improved large anodized aluminum golf club head and method of manufacturing same characterized by possessing a high yield strength, hardness, coefficient of restitution and wear resistance of the anodized surface layer or layers together with a high damping capacity, toughness and low density of the resultant head.

It is a further object of the invention to provide for a novel and improved metal product having a hard inner layer or sublayer and at least one anodized surface layer covering or partially covering the inner layer to achieve a material having an average hardness on the order of about 300 to 350 HBN.

It is an additional object to provide for a novel and improved method of manufacturing an aluminum alloy product having a hard anodized outer layer and wherein the inner or sublayer is composed of an aluminum alloy subjected to precipitation hardening and reverse quenching prior to combining with the outer layer; and further wherein the resultant article is characterized by being lightweight, high hardness and minimal cracking in the outer anodized layer.

In accordance with the present invention, there has been devised a novel and improved product or structure having a sublayer of a first aluminum alloy material and a hard anodized alumina outer surface layer at least partially covering said first material. Preferably, the product is a golf club head wherein the sublayer or body is hollow and composed of an aluminum alloy, and the outer surface layer is hard-anodized onto at least a portion of an external surface of the body to form a layer of alumina of predetermined thickness. It has been discovered that the hardness of the sublayer strongly influences that of the outer layer, and that the method of manufacture of the inner layer can substantially reduce the cracking of the hard-anodized outer layer thereby enabling the outer layer to be formed of increased thickness and further increase the hardness and related properties of the final product. The resultant product lends itself well to use in the manufacture of other products, such as, pump casings and other pump parts in that their wear resistance is related to hardness, for example, in combating abrasion from foreign particles passing through the pump.

The above and other objects, advantages and features of the present invention will become more readily appreciated and understood from a consideration of the following detailed description of preferred and modified forms of the present invention when taken together with the accompanying drawings in which:

DETAILED DESCRIPTION OF FIRST EMBODIMENT

The present invention is hereinafter described in relation to the construction and design of a metal golf club head of the type commonly referred to as a "metal wood". It will become evident, however, that this invention is readily conformable for use in the manufacture and construction of virtually any golf club including irons and putters.

Figure 1:
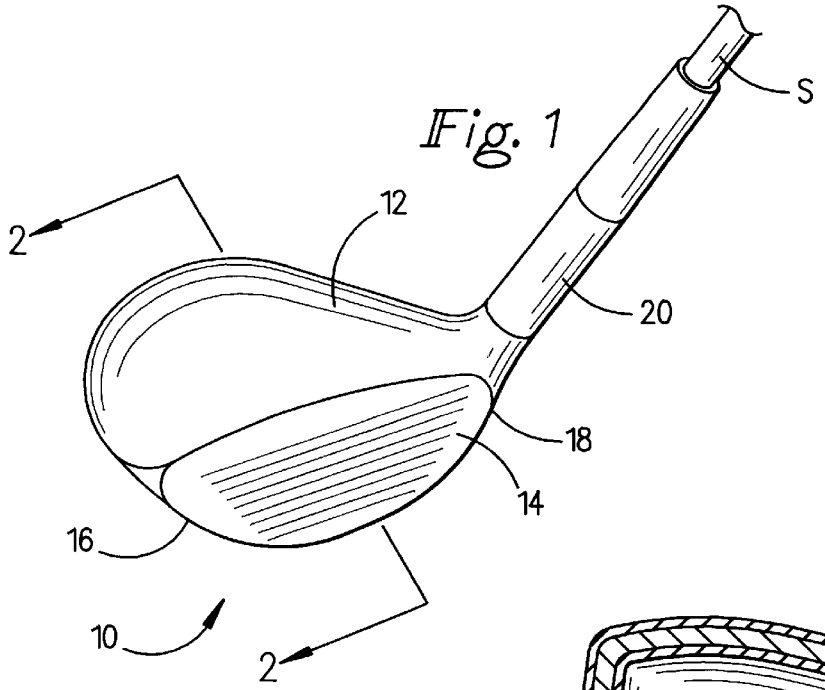
FIG. 1 is a somewhat fragmentary perspective view of a metal golf club head, customarily referred to as a "metal wood" in accordance with the present invention.
Figure 2:
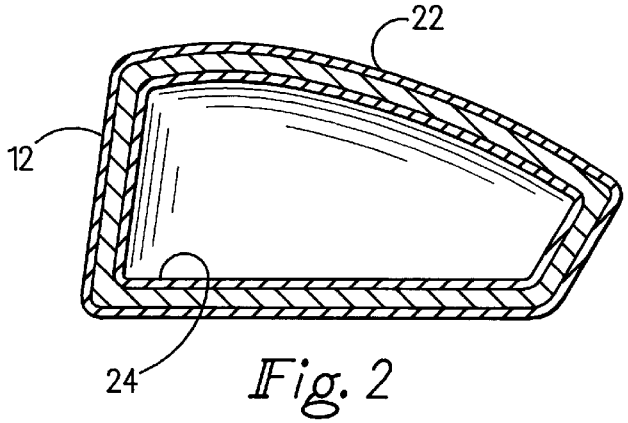
FIG. 2 is cross-sectional view taken above lines 2—2 of FIG. 1.

Referring to FIG. 1, a preferred form of golf club head 10 is made up of a hollow body 12 provided with a ball-striking face 14, a toe 16 and heel 18 verging into a hollow neck or socket portion 20. At least in plan view, the body is of generally circular configuration except for the relatively flat ball-striking surface 14 and, in accordance with conventional practice, the neck or socket 20 is adapted to receive a shaft S which terminates at its upper end in a grip or handle portion not shown.

In accordance with the present invention, the entire outer surface of the body 12 is coated or covered with an alumina anodized layer 22; and correspondingly, an alumina anodized layer 24 covers the entire inner hollow surface of the body 12. Preferably, this is carried out by "hard anodizing" as previously defined using a sulfuric acid bath having a weight concentration range of 10%–15% with or without addition of 12 g to 20 g oxalic acid $H_2C_2O_4$ per gallon of water in the electrolytic bath.

In carrying out the method of manufacture of the metal wood 10, the body 12 may be suitably composed of a 356 alloy according to the Aluminum Association Alloy Designation or ASTM SG70B which is a cast aluminum material having a thickness on the order of ¼" to ⅜". It will be apparent that other aluminum materials may be suitably employed and particularly aluminum cast alloys. In order to anodize the head, prior to attachment of the shaft S, the aluminum body 12 is completely immersed in a sulfuric acid bath so that both the inner and outer surfaces of the body 12 are exposed to the sulfuric acid solution. The sulfuric acid solution has a concentration of 9% to 20%, a current density of 24 to 30 A/ft$^2$ and a voltage up to 75V, the bath being maintained at a temperature level in the range of 25° F. to 32° F. A higher temperature may cause formation of soft and more porous outer layers of the outer anodic coating which significantly reduces the wear resistance and limits the coating thickness. Therefore, 32° F. is the preferred process temperature. The anodizing process typically requires on the order of 40 to 80 minutes in order to build up the surface layers 22 and 24 to a thickness on the order of 0.002 inch±10%. The process herein described lends itself well to mass production in which a great number of golf club heads may be anodized simultaneously and yet attain uniformity in thickness of the outer and inner surface layers 22 and 24. For example, the club heads 10 may be positioned in anodizing racks or fixtures and placed in the electrolytic bath in such a way as to permit good drainage, minimum gas effects and air entrapment as well as good current distribution. A recommended rack material is composed of aluminum or pure titanium.

In many anodizing processes, sealing of the anodized surface by boiling in water is employed in order to close the porosity which is generated through the hard anodizing process. However it is important to avoid sealing of the anodized surfaces which will lower their hardness; instead, the club head is thoroughly rinsed in cold water and dried after completion of the process. The shaft is then assembled onto the socket 20 to complete the head. If desired, the hollow interior of the golf club head may be filled with a plastic foam.

Anodizing is an inorganic surface treatment. Because the metal being oxidized is the anode in the system, the process is called anodizing. Films produced by electrolytic oxidation are thicker, harder and more resistant to abrasion and corrosion than films formed by simpler chemical treatment.

Furthermore, the hard anodic coatings differ from conventional coatings by having thicker films and are inherently more resistant to wear. During the aluminum anodizing process a continuous integral film, sometimes called barrier film, is formed. Because of the electrical resistance of the alumina film it will build up to a specific thickness under the first potential. With additional time the $Al_2O_3$ film continues to thicken but it becomes more porous. One of the shortcomings of anodized coatings particularly the thicker ones is the development of fissures. This is dependent upon the dielectric constant of the alumina film, the stability of the electrolytic solution and the solubility of the alumina film in the electrolyte at the operating temperature.

Any cracking tendency of the anodized layers may be avoided or at least minimized by shot peening at least the outer surface layer 22, by tempering, or by reverse quenching as hereinafter described. Because the inside of the golf club body 12 cannot be peened, tempering is preferred and can be accomplished either through heating at elevated temperatures or by cryogenic treatment. The weight increase of a 0.002 inch±10% anodized layer for the inside and outside surface layers 22 and 24 was found to be 8.64 g/ft$^2$. In this way, the overall density of the club is extremely low and enables construction of an enlarged golf club head on the order of 450 cm$^3$ volume.

Figure 3:
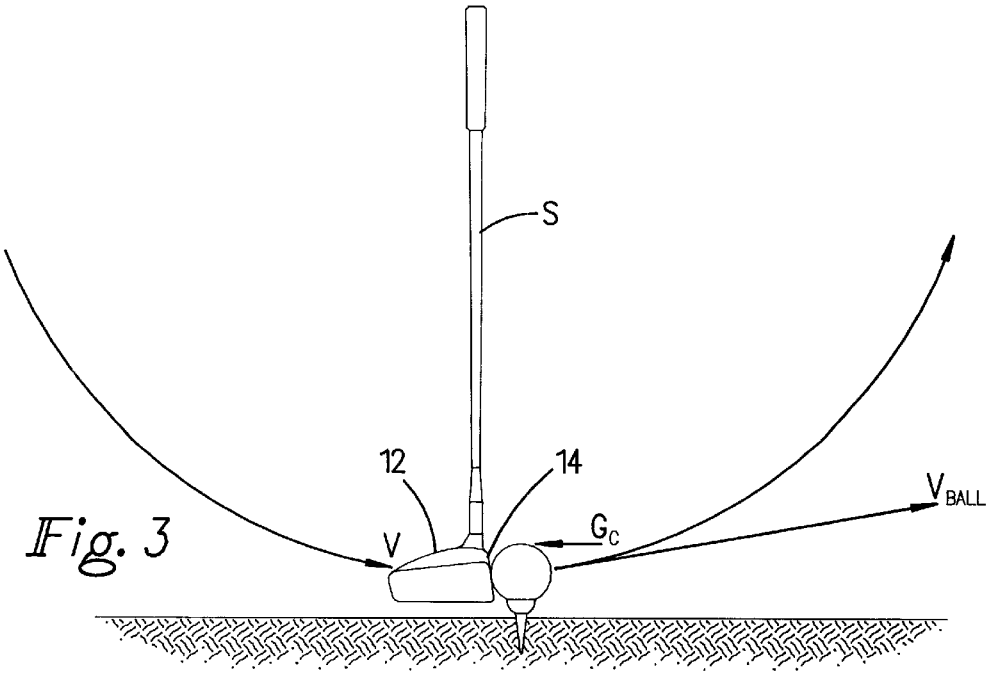
FIG. 3 is a somewhat schematic view illustrating the relationship between the approach velocity V and separation velocity $V_{ball}$ in striking a golf ball.

In striking a golf ball, an important consideration is the coefficient of restitution e; and, as represented in FIG. 3:

$$e = \text{relative separation velocity } (V_{ball}) / \text{relative approach velocity } (V).$$

An impact is said to be perfectly elastic if e=1. It is believed possible to obtain a coefficient of restitution in excess of 0.90 with anodized surface layers as described.

Another important factor in the construction of a golf club head is the compressive stress developed during the golf club swing. In the swing, mechanical work of 2,000 to 4,000 ft.lbf is generated. The rate of loading is very high and the inertia of the material elements as they flow through the deforming region may influence the stress field.

The initial compressive stress in the golf club head is according to the formula:

$$\sigma_C=\rho^*C_0{}^*V \quad [1]$$

$C_0$=the velocity of the compressive pulse or wave;

ρ=the density of the material;

V=the velocity of the golf club head.

During the swing of a professional athlete the velocity of the golf club head could reach 135 MPH or 60 m/s.

For elastic behavior the stress given in equation [1] must be less than the yield stress Y, consequently:

$$V/<Y/\rho^*C_0 \quad [2]$$

If an aluminum cast golf club head is manufactured the yield stress range is 8,000–40,000 psi.

By selecting the strongest aluminum cast alloy B195 or ASTM CS42A, the yield strength is: Y=40,000 psi or 275.86 $N/mm^2$ or 27,586 $N/cm^2$. The density of aluminum is:

$$\rho=2.7\ g/cm^3 \text{ or } 0.0974\ lb/in^3.$$

When the swing force of the golf club head is suddenly applied to the body of the golf ball a wave of stress will propagate through the golf club head.

The longitudinal wave speed in aluminum was calculated with the formula:

$$C_o=\sqrt{\frac{386.4E}{\rho}}$$

$$E=\text{module of elasticity } [lb/in^2]$$

$$C_o=\sqrt{\frac{38634\times 10.1\times 10^6}{0.0974}}=$$

$$200.17\times 1{,}000=200{,}170=200{,}170 \text{ in/s}$$

or 5,132.6 m/s

This value was rounded out to 5,200 m/s or 520,000 cm/s which is in agreement with the published data.

The maximum velocity of an aluminum golf club head which will not plastically deform at the contact surface, assuming that the yield strength is 40,000 psi, is:

$$V=\frac{27{,}586\ [N/cm^2]}{2.7\ [g/cm^3]\times 520{,}000\ [cm/s}=$$

$$=\frac{(1000/9.81)27{,}586\ [gf/cm^2]}{2.7\ [g/cm^3]\times 520{,}000\ [cm/s]}=$$

$$=\frac{(1000/9.81)\times(981)\times 27{,}586\ [gcm/s^2cm^2]}{2.7\ [g/cm^3]\times 520{,}000\ [cm/s]}$$

$$=\frac{100{,}000\times 27{,}586\ [cm/s]}{1{,}404{,}000}$$

$$=1{,}964.8\ [cm/s]=20\ m/s$$

Because the velocity of the golf club head could reach 60 m/s aluminum golf club heads are practical only if the outside layer is anodized.

The durability of aluminum or aluminum alloys is inferior because the modulus of elasticity is low ($E=10.1\times 10^6$ $lb/in^2$) and the repulsive forces are small. Also the strength, wear resistance and hardness are low for an aluminum material but can be increased substantially by hard anodizing the surfaces of the aluminum golf club head.

It is well known that increased damping capacity in the golf club head would eliminate vibrations in the shaft and will ensure "still hands" during the entire duration of the swing. The term "damping" refers to the energy dissipation properties of materials or systems and is a desirable property for suddenly applied forces. During the impact of the golf club head and the golf ball a uniaxial state of stress under compression conditions is generated in the golf club head. The hardness of the alumina anodized layer is in the range of 52 to 60 HRC or 400 to 600 HBN. After the instant of maximum compression the aluminum golf club head with anodized surfaces expend again. Since the anodized golf club head surface is perfectly elastic under the golf swing compression force and almost frictionless the energy absorbed in the wave motion is minimum and the deformation is reversible.

It is to be understood that the foregoing calculations above are more of a preliminary nature and are given for the purpose of illustration to highlight the features and characteristics of a golf club head constructed with hard anodized surface layers. It will be apparent that the striking characteristics of a golf club head can be markedly improved even with the elimination of the inner alumina surface layer; or, in other words, anodizing only the external surface of the body. This could be beneficial, for example, in the manufacture of irons and putters. Moreover, anodizing may be performed with other acid solutions, such as, chromic acid but is not believed to be as effective as a sulfuric acid solution.

Similarly, on clubs that do not require the same yield strength or coefficient of restitution, such as, at the beginner level or for junior players, it may be desirable to dispense with the inner surface layer. Still further, in certain head constructions the anodized surface layer(s) could be restricted to the ball-striking face 14.

DETAILED DESCRIPTION OF PREFERRED EMBODIMENTS

In order to enhance the hardness characteristics of the hard-anodized outer surface layer as hereinbefore described, most desirably the sublayer is composed of an aluminum alloy which possesses maximum hardness. This is best illustrated by the following working examples:

EXAMPLE I

An aluminum alloy is composed of the following ingredients given in % by weight of the entire composition:

| | |
|---|---|
| Silicone | 0.15 |
| Iron | 0.15 |
| Copper | 0.1 |
| Manganese | 0.1 |
| Magnesium | 0.8–1.0 |
| Chromium | 0.06–0.2 |
| Zinc | 6.5–7.5 |
| Titanium | 0.1–0.2 |
| Aluminum | (balance) |

The alloy is cast into a hollow club head as described and then treated by a succession of two standard precipitation hardening steps followed by reverse quenching in which the alloy is cryogenically treated by immersing in water at about −105 degrees F. and thereafter immersing in water at a temperature approximating that of boiling water. After reverse quenching, the hardness of the alloy is in the range of 140–160 HBN. Subsequent treatment is carried out by hard-anodizing in a sulfuric acid bath to form a barrier film on the order of 0.003" thick on the interior and exterior surfaces of the body. The resultant product had a tensile strength of 54,900 psi, yield strength of 36,800 psi and 11% elongation.

EXAMPLE II

Another aluminum alloy body for a golf club was cast with the following composition (% by weight)

| | |
|---|---|
| Silicone | 0.4 |
| Iron | 0.5 |
| Copper | 1.2–2.0 |
| Manganese | 0.3 |
| Magnesium | 2.1–2.9 |
| Chromium | 0.18–0.28 |
| Zinc | 5.8–6.1 |
| Titanium | 0.2 |
| Aluminum | (bal) |

After casting, the body is treated by precipitation hardening and reverse quenching as described in Example I above but, owing to the increased copper content will approach a hardness of 190–210 HBN. The body was hard-anodized in a sulfuric acid bath to form a barrier film of the desired thickness on the order of 0.003". The tensile strength was measured at 85,100 psi, the yield strength was at 73,000 psi, and an elongation of 8%.

The increased hardness of the body in Examples I and II over that of the 356 alloy results in greatly increased hardness and yield strength of the structure of the golf club head as well as improved impact resistance and coefficient of restitution which are so important to ball-striking efficiency. As previously noted, the number of cracks in the outer layer is reduced by the altered characteristics of the inner or sublayer thereby enabling formation of increased wall thickness of the outer layer and consequent increased overall hardness with minimal cracking in the outer wall or layer of the final product. It is theorized that the reverse quenching of the aluminum alloy results in a homogenous structure with minimum internal energy. In this condition, the alloy has dimensional stability and is shock-resistant thereby leading to reduced cracking in the outer layer.

It is therefore to be understood that the above and other modifications and changes may be made in the construction of golf club heads and other athletic implements as well as the method of manufacturing same without departing from the spirit and scope of the present invention.

I claim:

1. A golf club head comprising a hollow body composed of an aluminum alloy, said body having a ball-striking face, and an outer layer coated to and covering at least said ball-striking face, and wherein said outer layer is composed of a hard-anodized alumina.

2. A golf club head according to claim 1 wherein said body is precipitation hardened and reverse quenched prior to being coated by said outer layer.

3. A golf club head according to claim 1 wherein said body is thicker than said outer layer.

4. A golf club head according to claim 1 wherein an inner layer is coated to an internal surface of said body, said inner layer being composed of a hard-anodized alumina of a greater hardness than said body.

5. A golf club head according to claim 4 wherein said inner and outer layers are hard-anodized in a sulfuric acid bath.

6. A golf club head comprising a hollow body composed or an aluminum alloy, said body having internal and external surfaces and a ball-striking face on said external surface, and an outer layer coated to said external surface of said body, said outer layer being composed of a hard-anodized alumina of a greater hardness than said body.

7. A golf club head according to claim 6, wherein said body is thicker than said outer layer.

8. A golf club head according to claim 6, wherein said outer layer completely covers said body.

9. A golf club head according to claim 6, wherein said second layer covers internal and external surfaces of said body.

* * * * *